US009434088B2

(12) United States Patent
Shimizu et al.

(10) Patent No.: US 9,434,088 B2
(45) Date of Patent: Sep. 6, 2016

(54) REFILL CASE AND STAPLE CARTRIDGE

(75) Inventors: Toshio Shimizu, Tokyo (JP); Futoshi Kameda, Tokyo (JP)

(73) Assignee: MAX CO., LTD., Tokyo (JP)

( * ) Notice: Subject to any disclaimer, the term of this patent is extended or adjusted under 35 U.S.C. 154(b) by 1235 days.

(21) Appl. No.: 12/868,108

(22) Filed: Aug. 25, 2010

(65) Prior Publication Data

US 2011/0089215 A1 Apr. 21, 2011

(30) Foreign Application Priority Data

Oct. 19, 2009 (JP) ..... 2009-240009

(51) Int. Cl.
*B27F 7/38* (2006.01)

(52) U.S. Cl.
CPC ..... *B27F 7/38* (2013.01)

(58) Field of Classification Search
USPC ..... 227/8, 120, 136, 131, 156; 206/338, 206/340
See application file for complete search history.

(56) References Cited

U.S. PATENT DOCUMENTS 4,978,045 A * 12/1990 Murakami et al. ..... 227/1
5,560,529 A * 10/1996 Udagawa et al. ..... 227/136
6,616,027 B2 * 9/2003 Mochizuki ..... 227/131
7,353,975 B2 4/2008 Haramiishi et al.
7,571,842 B2 8/2009 Kishi et al.
2005/0269380 A1 12/2005 Shimizu et al.
2006/0054654 A1 3/2006 Haramiishi et al.
2006/0144890 A1 7/2006 Haramiishi et al.
2008/0083805 A1 * 4/2008 Haramiishi et al. ..... 227/129
2008/0135597 A1 6/2008 Kishi et al.

FOREIGN PATENT DOCUMENTS

CN 1665645 A 9/2005
CN 1750915 A 3/2006
CN 1997488 A 7/2007
JP 7-215565 8/1995

* cited by examiner

*Primary Examiner* — Nathaniel Chukwurah
(74) *Attorney, Agent, or Firm* — Drinker Biddle & Reath LLP

(57) ABSTRACT

A refill case (A) is provided with: an accommodating part (2) in which staple-sheets, each of which is formed by connecting straight staple members in a sheet shape, are stacked in an up/down direction and accommodated; a front wall (8*a*); a leading-out port (3) formed in the front wall (8*a*), and from which a lowermost staple-sheet of the stacked staple-sheets in the accommodating part is led out forward; and an eaves part (7) formed in an upper side of the leading-out port (3). The eaves part (7) includes a front end (7F) positioned in a front side of the front wall (8*a*) and a lower surface (7L) formed between the front end (7F) and the front wall (8*a*).

5 Claims, 8 Drawing Sheets

REFILL CASE AND STAPLE CARTRIDGE

BACKGROUND OF THE INVENTION

1. Field of the Invention

The present invention relates to a refill case for accommodating staple-sheets formed by connecting straight staple members, and to a staple cartridge into which the refill case is attached so as to supply staples to an electric stapler.

2. Related Art

A paper handling device used as a paper finisher provided at a back stage of an image forming apparatus such as a copying machine or a printer includes an electric stapler for stapling plural paper sheets in a set (refer to Patent Document 1). The electric stapler is so constituted as to be capable of attaching and detaching a staple cartridge. The staple cartridge is so constituted as to be capable of attaching and detaching a refill case in which staple-sheets, each of which is formed by connecting straight staple members in a sheet shape, are stacked and accommodated. Further, the electric stapler is frequently arranged so that a staple is driven out from a downside and penetrates the paper sheets and legs of the penetrating staple are bent from an upside. Further, in order to easily feed the paper sheets, the electric stapler is frequently installed in a slant state.

In the staple cartridge, an attachment part for attaching the refill case is formed (refer to Patent Document 2). On a front side of the attachment part, a pressing part is formed being protruded backward, and on a back side of the attachment part, a locking part is formed. When the refill case is attached to the staple cartridge, first, a front lower portion of the refill case is pushed obliquely downward into the staple cartridge so that the front lower portion enters a lower portion of the pressing part of the attachment part. Thereafter, the whole of the refill case is rotated downward around the front lower portion of the refill case, and a back portion of the refill case is locked to the locking part of the attachment part, whereby the refill case is attached to the staple cartridge.

[Patent Document 1] JP-A-7-215565

[Patent Document 2] US2006/0144890

However, according to this attachment mode, when the refill case is rotated downward around the front lower portion of the refill case, a front upper portion of the refill case moves backward and separates from the attachment part of the staple cartridge. Therefore, a clearance gap is produced between the refill case and the staple cartridge.

Therefore, in an electric stapler of a type of driving out a staple from a downside toward an upside, when the electric stapler is operated erroneously in a state where the paper sheets do not exist, an idle-driven staple moves from the staple cartridge along a slant to the clearance gap side between the refill case and the staple cartridge due to vibration of stapling operation. Then, the idle-driven staple further falls from this clearance gap inside the staple cartridge, and enters a feeding path through which the staple led out from the refill case is fed to a drive-out part located at the leading end of the staple cartridge, whereby there is possibility that poor feeding may be caused.

SUMMARY OF THE INVENTION

One or more embodiments of the invention provide a refill case which can surely prevent an unnecessary object such as an idle-driven staple from entering an inside from a clearance gap between a staple cartridge and the refill case when the refill case is attached to the staple cartridge.

In addition, one or more embodiments of the invention provide a staple cartridge which can suppress the clearance space produced between the refill case and the staple cartridge to such a degree that the staple cannot pass.

In accordance with one or more embodiments of the invention, a refill case (A) is provided with: an accommodating part (2) in which staple-sheets, each of which is formed by connecting straight staple members in a sheet shape, are stacked in an up/down direction and accommodated; a front wall (8*a*); a leading-out port (3) formed in the front wall (8*a*), and from which a lowermost staple-sheet of the stacked staple-sheets in the accommodating part is led out forward; and an eaves part (7) formed in an upper side of the leading-out port (3). The eaves part (7) includes a front end (7F) positioned in a front side of the front wall (8*a*) and a lower surface (7L) formed between the front end (7F) and the front wall (8*a*).

Further, in the above structure, the refill case (A) may include an engaging part (10) formed in a position in a lower side of the eaves part (7) and in an upper side of the lead-out port (3), and protruding forward from the front wall (8*a*). An upper end of the engaging part (10) is apart from the lower surface (7L) of the eaves part (7) in the up/down direction.

According to the above structure, in the front wall of the accommodating part, there is formed the leading-out port from which the lowermost staple-sheet is led out, and above the opening portion of the staple leading-out port, the eaves part which prevents entry of an unnecessary object is formed protrusively. Therefore, when the refill case is attached to the staple cartridge, by forming the eaves part in a position having no interference with the staple cartridge, the gap space formed between the eaves part and the staple cartridge is covered with the eaves part, and this gap space can be made small, so that it is possible to prevent surely the unnecessary object such as the idle-driven staple from entering the inside.

Moreover, in accordance with one or more embodiment of the invention, a staple cartridge (B) is provided with: a pressing part (13) configured to engage with an engaging part (10) protruding from a front wall (8*a*) of a refill case (A); and a protrusion (17) formed on the pressing part (13) and configured to oppose in an up/down direction to a lower surface (7L) of an eaves part (7) of the refill case (A). The protrusion (17) is structured so that a gap between the lower surface (7L) of the eaves part (7) and the protrusion (17) is smaller than a thickness of a staple (1*a*) in a state that the refill case (A) is attached to the staple cartridge (B).

According to the above structure, the pressing part which engages with the engaging part protruding from the above front wall of the refill case when the refill case is attached is formed at the attachment part of the staple cartridge, and the protrusion which is opposed to the above eaves part up and down is formed at this pressing part. Therefore, when the engaging part is engaged with the pressing part to attach the refill case to the staple cartridge, the eaves part and the protrusion are opposed to each other up and down, but the up and down clearance gap between the eaves part and the protrusion can be adjusted so that any trouble is not produced in the operation of attaching the refill case to the staple cartridge. Since the gap space between the refill case and the staple cartridge is made smaller than the thickness of the staple, it is possible to prevent surely the unnecessary staple from entering between the refill case and the staple cartridge.

In the above structure, the staple cartridge (B) may include: a staple guide part (18) including a feeding path (20) for guiding a staple-sheet led out from a leading-out port (3) of the refill case (A), wherein a drive-out part (23) in which a staple fed out from the feeding path (20) is driven from a downside to an upside is formed at a front end of the staple guide part (18). An upper surface of the staple guide part (18) and an upper surface of the pressing part (13) may be continuously formed.

According to the above structure, on the pressing part side of the above attachment part, the staple guide part having the feeding path for guiding a lowermost staple-sheet led out from the leading-out port of the refill case is protrusively formed; at the leading end of the staple guide part, the drive-out part which drives out a staple fed out from the above feeding path from the downside to the upside is formed; and the upper surface of the above staple guide part and the upper surface of the above pressing part are formed continuously. Therefore, when idle-stapling is erroneously performed, the idle-driven staple might move from the upper surface of the staple guide part to the upper surface of the pressing part due to vibration produced in the sequential stapling time, but it cannot enter the inside of the staple cartridge from the gap space between the eaves part of the refill case and the attachment part of the staple cartridge. Accordingly, even in case that the electric stapler on which the staple cartridge has been mounted is set slantingly so that the upper surface of the staple guide part becomes high in height and the upper surface of the pressing part becomes low, stable staple feeding can be always secured without causing poor feeding.

DETAILED DESCRIPTION OF THE EXEMPLARY EMBODIMENTS

Figure 1:
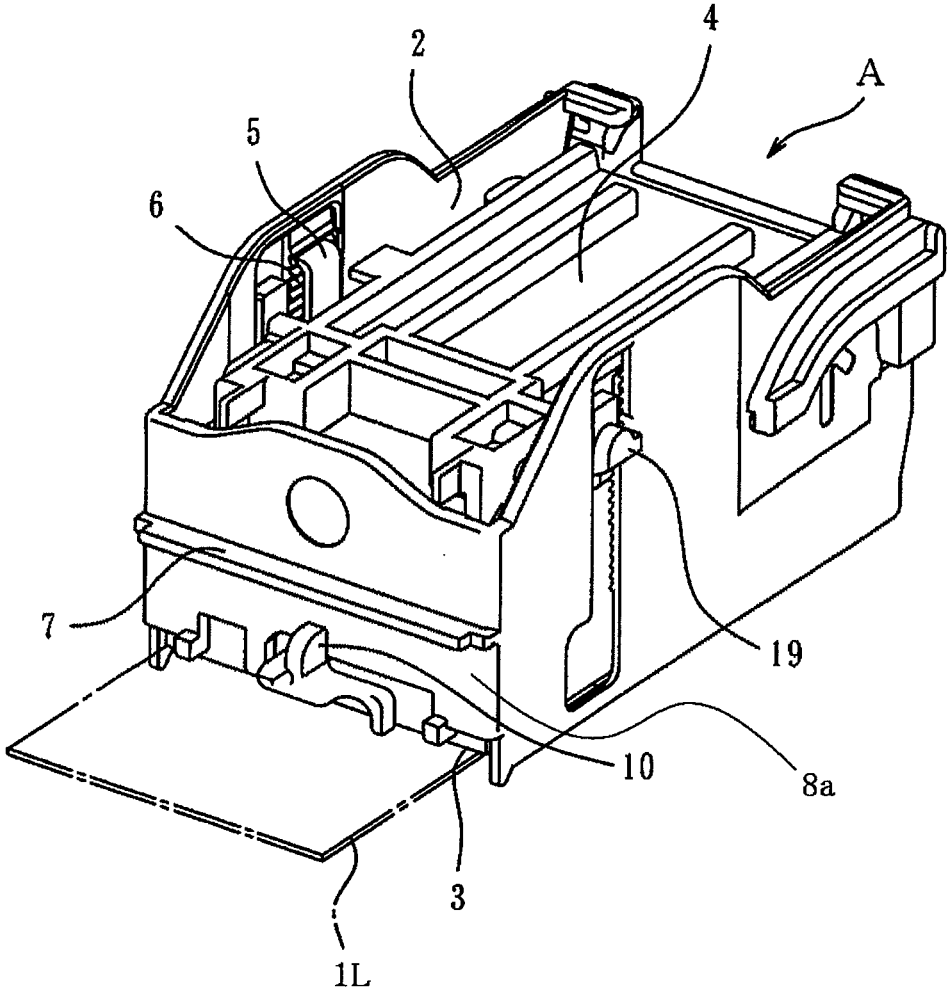
FIG. 1 is a perspective view of a refill case according to an exemplary embodiment of the invention.
Figure 2:
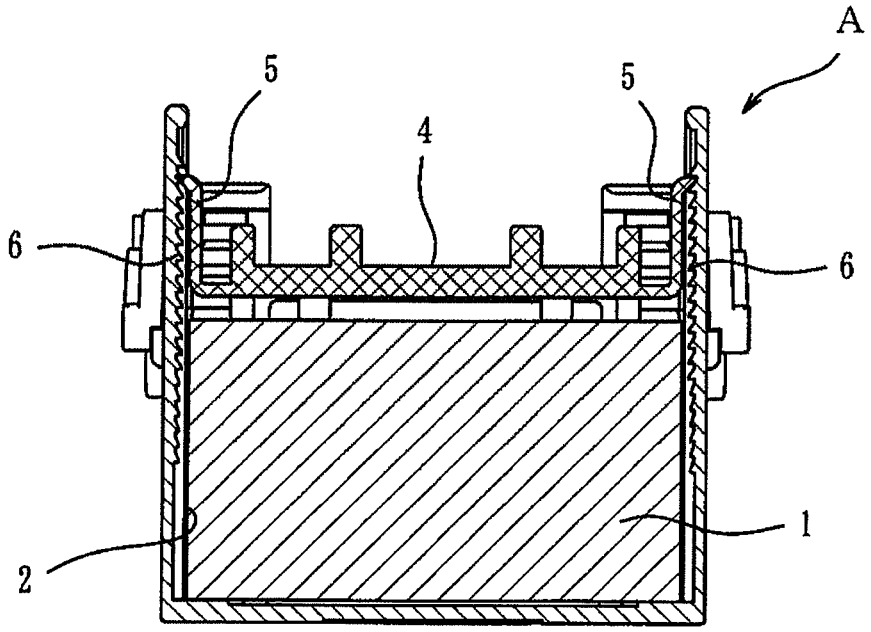
FIG. 2 is a longitudinal sectional view of the refill case.

FIG. 1 is a perspective view of a refill case made of synthetic resin, and FIG. 2 is a longitudinal sectional view of the refill case. In the same figures, a reference character A represents the refill case made of synthetic resin. This refill case A includes an accommodating part 2 in which staple-sheets 1 are accommodated in a lamination manner; a leading-out port 3 formed in a front wall of the accommodating part 2, which leads out a lowermost staple-sheet 1L; and a staple pressing member 4 made of synthetic resin, which is arranged at the top of the staple-sheets 1 accommodated in the accommodating part 2. This staple pressing member 4 is used in order to prevent the accommodated staple-sheets 1 from getting out of an upper opening portion of the refill case A due to vibration in the conveying time or in the stapling time. At both ends of the staple pressing member 4, return-preventing claws 5 are formed, which lock into locking grooves 6 each having a saw-toothed section and formed in the inner surface of the accommodating part 2.

Figure 3:
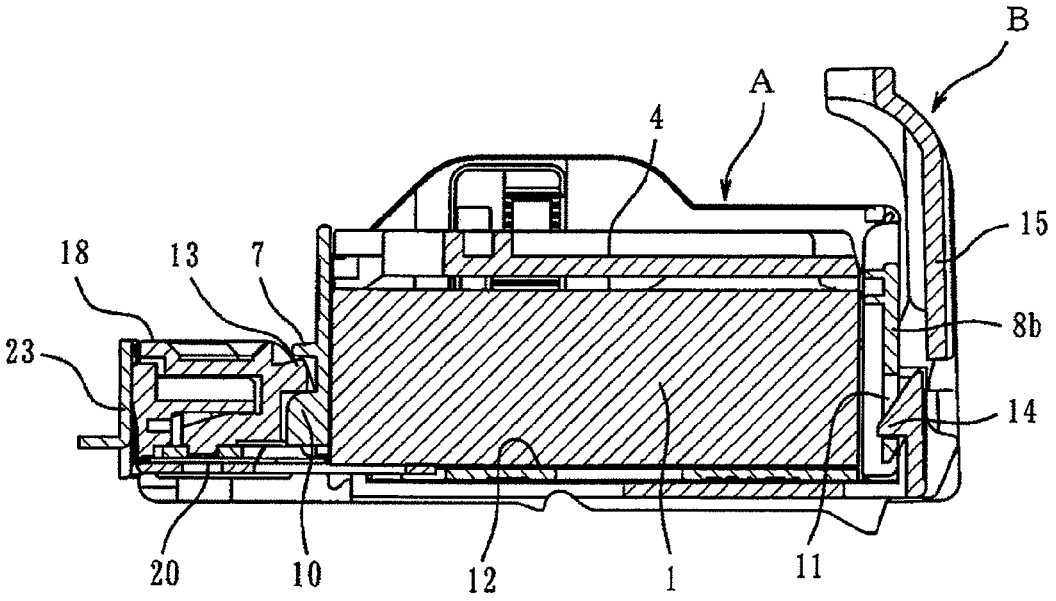
FIG. 3 is a sectional view showing a state where the refill case is attached to a staple cartridge.
Figure 4:
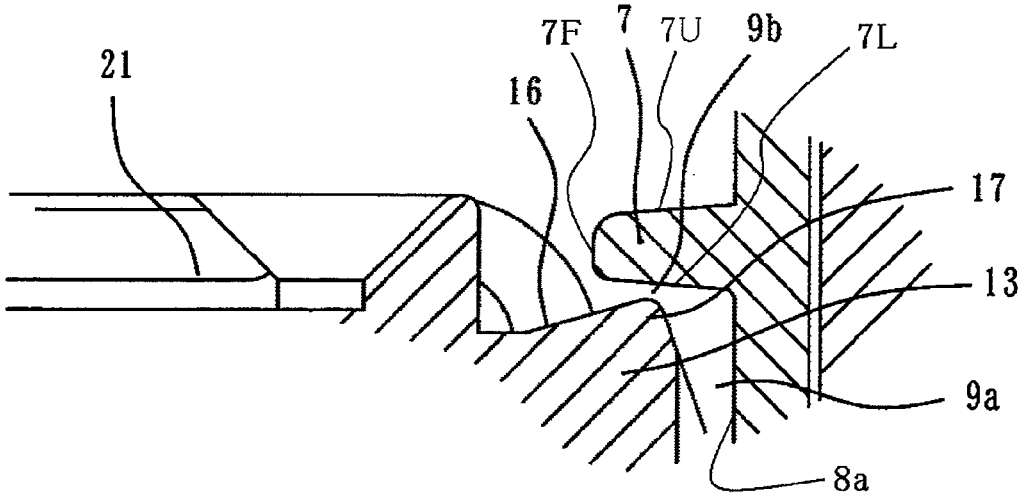
FIG. 4 is a partially enlarged view of FIG. 3.
Figure 5:
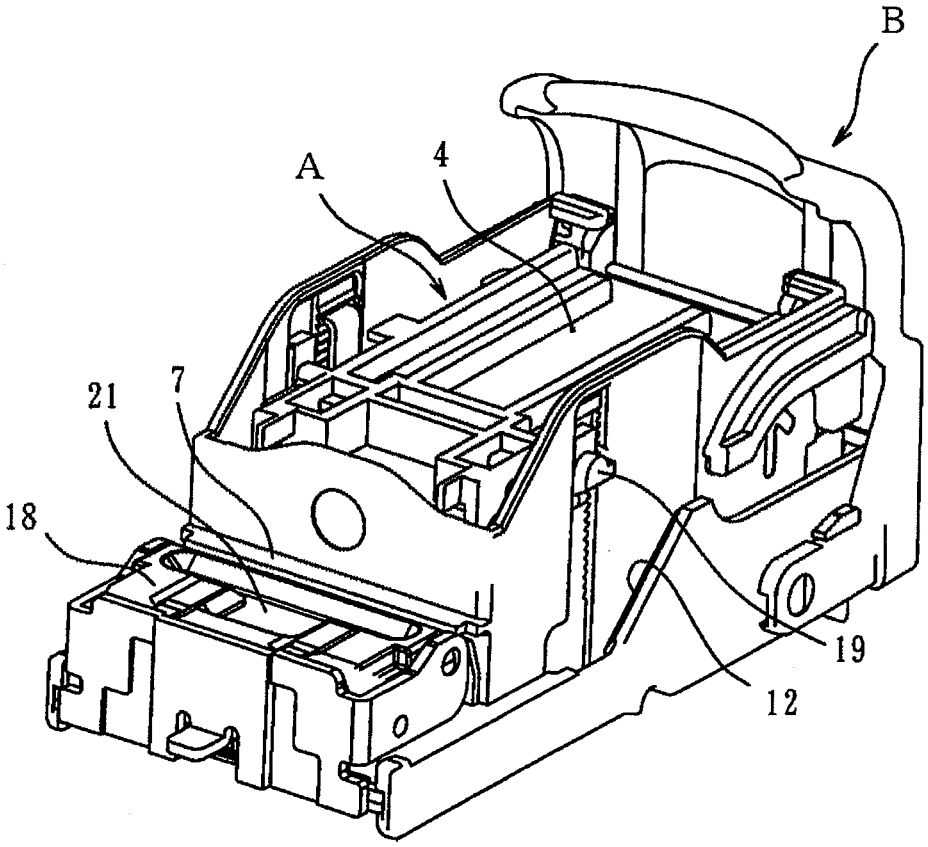
FIG. 5 is a perspective view showing a state where the refill case is attached to the staple cartridge.
Figure 6:
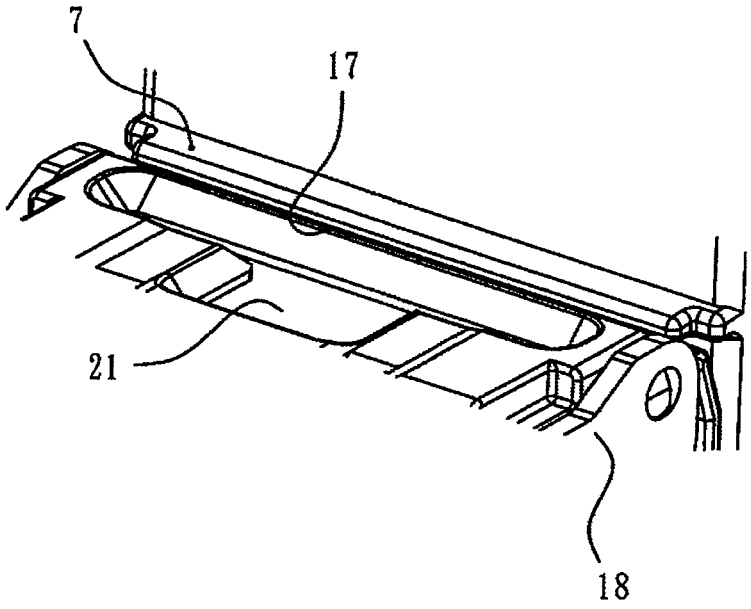
FIG. 6 is a partially enlarged view of FIG. 5.

Further, above the opening portion of the staple leading-out port 3, an eaves part 7 is formed, which protrudes from the outside of a front wall 8*a* of the accommodating part 2. As shown in FIG. 4, the eaves part 7 includes a front end 7F positioned in a front side of the front wall 8*a*, a lower surface 7L formed between the front end 7F and the front wall 8*a*, and an upper surface 7U. Further, as shown in FIG. 3, at the front wall 8*a* and at a rear wall 8*b*, an engaging part 10 and a locking hole 11 are formed respectively. The engaging part 10 is protrusively formed below the eaves part 7. An upper end of the engaging part 10 is apart from the lower surface 7L of the eaves part 7 in the up/down direction.

Each of the staple-sheet 1 is formed by connecting straight staple members in the shape of a sheet with an adhesive. The staple member is formed in U-shape by an electric stapler C described later and thereafter driven out.

Next, in FIGS. 3 to 6, a reference character B is a staple cartridge for attaching and detaching the refill case A, in which an attachment part 12 for attaching the refill case A is formed. At the front upper portion of the attachment part 12, a pressing part 13 for the refill case A is formed being protruded inward. At the back portion of the attachment part 12, a locking piece 15 having a locking jaw 14 is formed downward. An upper surface 16 of the pressing part 13 is formed into a slant face in which a front portion is low in height and a back portion is high, and a protrusion 17 is formed at the back end of the slant face. The upper surface 16 of the pressing part 13 is formed, as described later, in the lower position than the position of the eaves part 7 so as not to interfere with the eaves part 7 when the refill case A is attached.

On the front side of the attachment part 12, a staple guide part 18 is formed protrusively. At the lower portion of the staple guide part 18, a feeding path 20 for the lowermost staple-sheet 11, is formed. To the contrary, on the upper surface of the staple guide part 18, a receiving part 21 is formed. The upper surface of the receiving part 21, as shown in FIG. 4, is formed so as to continue to the upper surface 16 of the pressing part 13. A front end of the feeding path 20 opens to a drive-out part 23 formed penetratingly in the up-down direction.

Under the above constitution, in case that the refill case A is attached to the attachment part 12 of the staple cartridge B as shown in FIG. 3, the engaging part 10 of the front wall 8*a* of the refill case A is obliquely forward pushed into the lower portion of the pressing part 13 of the attachment part 12. Thereafter, the refill case A is downward moved rotationally around the leading end of the engaging part 10, and the locking jaw 14 of the locking piece 15 of the attachment part 12 is locked into the locking hole 11 of the refill case A. Under the attached state, a clearance gap 9*a* between the refill case A and the staple cartridge B is covered with the eaves part 7 as shown in FIG. 4.

Further, in case that the refill case A is attached by the rotational movement in the above manner, a gap space 9*b* is formed between the eaves part 7 and the stable cartridge B by the up-down positional relation between them. However, the upper surface 16 of the pressing part 13 is formed in such a manner that the leading end of the eaves part 7 of the refill case A moves along the slant of the upper surface 16 of the pressing part 13 without interference when the refill case A moves rotationally in the attachment time. Thus, since the refill case A and the staple cartridge B can be constituted so that there is not any trouble in the operation of attaching the refill case A to the staple cartridge B, the eaves part 7 is opposite to the upper portion of the protrusion 17 in the attachment completing time. The gap space 9*b* between the upper eaves part 7 and the lower protrusion 17 is set so as to become smaller than the thickness of the staple.

Figure 7:
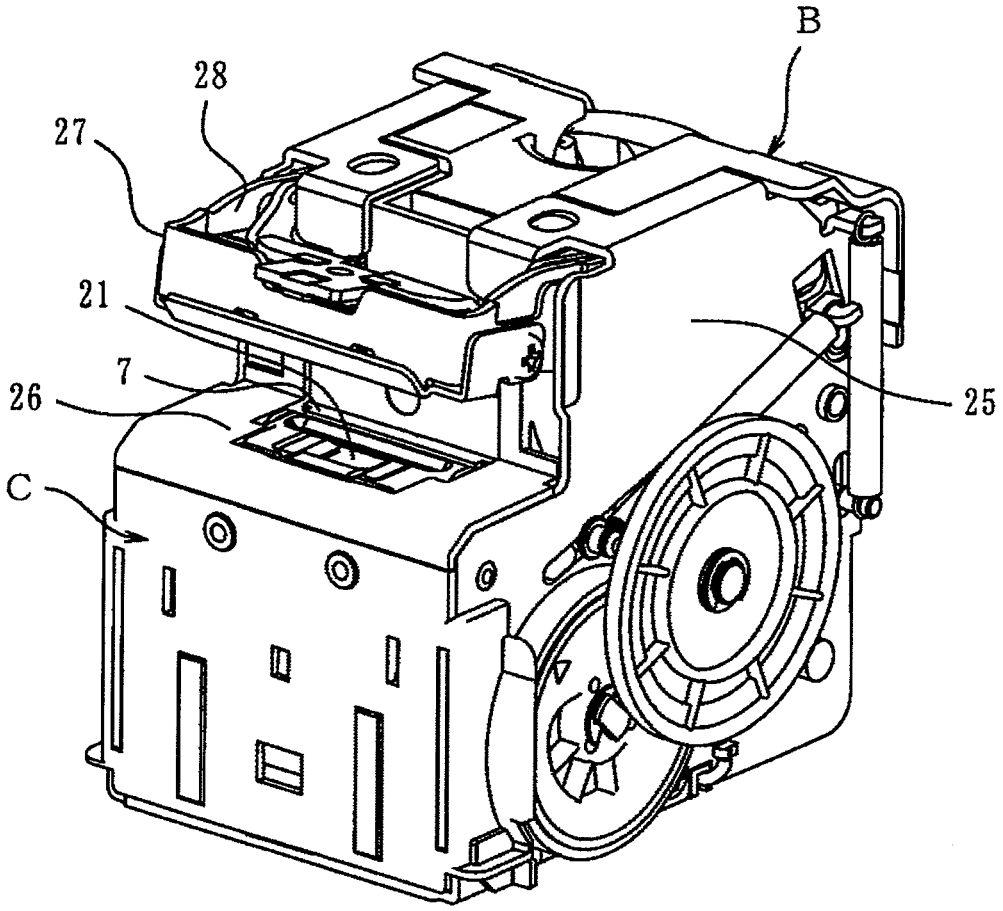
FIG. 7 is a perspective view of an electric stapler.
Figure 8:
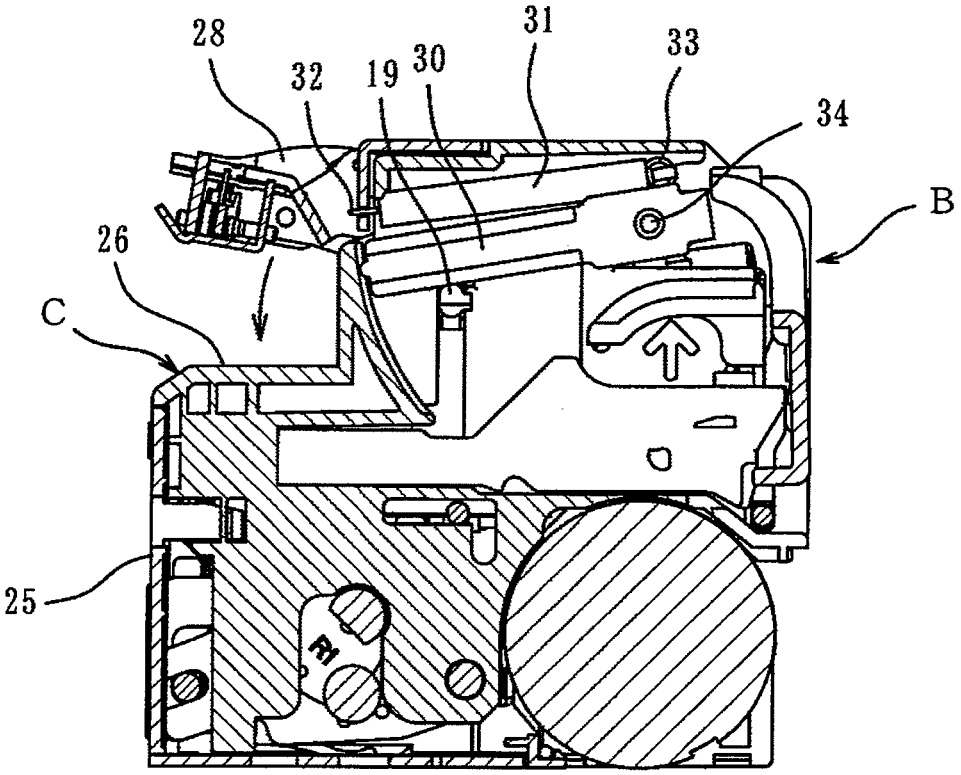
FIG. 8 is a sectional view of the electric stapler in a state where the above staple cartridge is attached.

Next, the staple cartridge B to which the refill case A has been attached is constituted so as to be detachably attached to the electric stapler C as shown in FIGS. 7 and 8. The electric stapler C is mounted on a paper handing device used as a paper finisher provided in a back stage of an image forming apparatus such as a copying machine or a printer. For a stapler body 25, a stapling table 26 which supports the paper sheets from the downside is provided; below the stapling table 26, a not-shown staple forming and driving part is provided; and above the stapling table 26, a clincher drive part 27 is provided swingably in the up and down direction.

The forming and driving part is a section which forms staples fed out sequentially from the staple cartridge B and drives out the formed staple, in which there is provided a forming and driving mechanism which includes a forming plate for forming a staple in the U-shape and a driver for driving out the formed staple. The clincher drive part 27 includes, at a leading end of a drive link 28 provided swingably for the stapler body 25, a movable clincher which bends leg portions of the staple driven out by the driver and penetrating the paper sheets. Since both the forming and driving mechanism and the clincher drive part are known, the description of them is omitted.

Further, on both sides of the back portion of the electric stapler C, as shown in FIG. 8, push bars 30 are provided. The back portion of the push bar 30 is attached pivotally by a pivot 34 provided for the stapler body 25. Above the push bar 30, an extension spring 31 is arranged, which has a front end 32 locked to the stapler body 25 and a back end 33 locked to a back end upper portion of the push bar 30. Accordingly, by the action of the extension spring 31, the front end of the push bar 30 is always energized so as to move downward.

Under the above constitution, when the staple cartridge B is inserted from the backside of the stapler body 25 and attached to the stapler body 25, a projection 19 (refer to FIGS. 1 and 8) protruding from the staple pressing member 4 of the refill case toward the outside engages with the lower surface of the push bar 30. When the staple cartridge B continues to be inserted and attached in the predetermined position, the push bar 30 is pushed up to the uppermost portion as shown in FIG. 8. Accordingly, since the staple pressing member 4 is pressed downward by the push bar 30, the staple-sheets 1 in the refill case A is held down by the staple pressing member 4. The return-preventing claw 5 of the staple pressing member 4, in the descending time, gets over the locking groove 6 formed in the inner surface of the accommodating part 2, and, when the staple pressing member 4 attempts to ascend, locks to the locking groove 6 thereby to prevent the staple pressing member 4 from floating. Further, the drive-out part is arranged so as to correspond to the driver and the movable clincher. Further, the receiving part 21 of the staple cartridge B is arranged inside the stapling table 26.

When the paper sheets are stapled, the lowermost staple-sheet 1L in the refill case A, as shown in FIG. 3, is previously fed to the feeding path 20 in the staple cartridge B by a feeding means (not shown) and formed in the U-shape by the forming plate, and thereafter a leading staple is supplied to the drive-out part 23. At this time, the paper sheets are prepared and placed on the stapling table 26, and a switch is turned on. Then, the drive link 28 swings downward and clamps the paper sheets between the stapling table 26 and the clincher drive part 27. Thereafter, the formed staple is driven out upward by the driver (simultaneously, the next staple is formed), and the driven-out staple penetrates the paper sheets and protrudes from the paper sheets. Next, the protruded staple portion is bent by the movable clincher along the face of the paper sheet to be stapled, and stapling is completed. After the stapling has been completed, the drive link 28 returns and moves to the upper waiting position.

Figure 9:
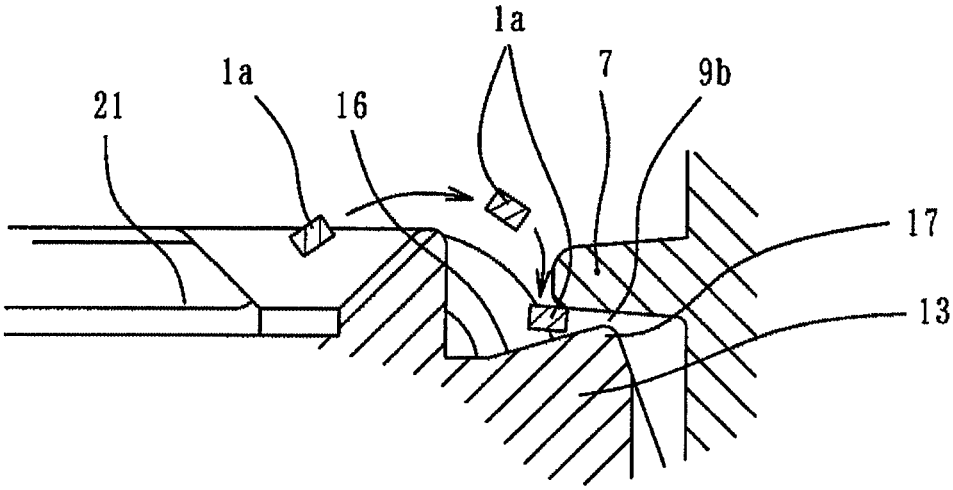
FIG. 9 is a sectional view showing how entry of an idle-driven staple from a gap space in FIG. 4 is prevented.

If the electric stapler C is erroneously operated in a state where there are no paper sheets, the idle-driven staple 1*a* remains on the receiving part 21 of the staple cartridge B inside the stapling table 26. In case that the electric stapler C is attached to the paper handling device obliquely so that the rear portion of the electric stapler C becomes low in height, as shown in FIG. 9, there is possibility that the unnecessary staple 1*a* remaining on the staple cartridge B further moves from the upper surface of the receiving part 21 to the upper surface 16 of the pressing part 13 due to the vibration in the stapling time, and enters between the eaves part 7 of the refill case A and the protrusion 17 of the staple cartridge B. However, since the gap space 9*b* between the eaves part 7 and the protrusion 17 is made smaller than the thickness of the staple 1*a*, the unnecessary staple 1*a* cannot enter the inside of the staple cartridge B from the gap space 9*b*. Therefore, the idle-driven staple 1*a* does not enter into the feeding path 20 for the staple-sheet 1L, and the stable staple-feeding can be always secured. Not only the staple but also another unnecessary object having the same thickness as the thickness of the staple or the larger thickness cannot enter the inside from the gap space 9*b*.

In the above exemplary embodiment, though the engaging part 10 is formed protrusively below the eaves part 7, the engaging part may be formed protrusively above the part 7 to the contrary to engage with the pressing part. In this case, between the eaves part and the lower surface of the engaging part, a gap space is formed.

DESCRIPTION OF REFERENCE NUMERALS AND SIGNS

A Refill case
B Staple cartridge
C Electric stapler
1 Staple-sheet
2 Accommodating part
3 Staple leading-out port
4 Staple pressing member
7 Eaves part
9*b* Gap space
12 Attachment part
13 Pressing part
17 Protrusion
18 Staple guide part
23 Drive-out part
26 Stapling table

What is claimed is:

1. A refill case comprising:

an accommodating part in which staple-sheets, each of which is formed by connecting straight staple members in a planar sheet shape, are stacked in an up/down direction and accommodated;

a front wall extending in the up/down direction;

a leading-out port formed in the front wall, and from which a lowermost staple-sheet of the stacked staple-sheets in the accommodating part is led out forward; and an eaves part formed in an upper side of the leading-out port, wherein the eaves part includes a front end positioned in a front side of the front wall and a lower surface formed between the front end and the front wall such that the eaves part extends from the front wall.

2. The refill case according to claim 1, further comprising:

an engaging part formed in a position in a lower side of the eaves part and in an upper side of the lead-out port, and protruding forward from the front wall, wherein an upper end of the engaging part is apart from the lower surface of the eaves part in the up/down direction.

3. The refill case according to claim 2, wherein the eaves part further includes an upper surface formed between the front end and the front wall in an opposite side of the lower surface in the up/down direction.

4. A staple cartridge comprising:

a pressing part configured to insert in a space defined between an engaging part protruding from a front wall of a refill case and an eaves part protruding from the front wall of the refill case, and configured to engage with the engaging part protruding from the front wall of the refill case; and a protrusion formed on the pressing part and configured to face a lower surface of the eaves part of the refill case;

wherein the protrusion is structured so that a gap between the lower surface of the eaves part and the protrusion is smaller than a thickness of a staple when the refill case is attached to the staple cartridge and the pressing part is inserted in the space defined between the engaging part and the eaves part.

5. The staple cartridge according to claim 4, further comprising:

a staple guide part including a feeding path for guiding a staple-sheet led out from a leading-out port of the refill case, wherein a drive-out part in which a staple fed out from the feeding path is driven from a downside to an upside is formed at a front end of the staple guide part;

wherein an upper surface of the staple guide part and an upper surface of the pressing part are continuously formed.

* * * * *